US007377880B1

(12) United States Patent
Maser

(10) Patent No.: US 7,377,880 B1
(45) Date of Patent: May 27, 2008

(54) PIVOTAL ADD-ON APPARATUS FOR STEPPER

(76) Inventor: Donald Clifton Maser, 325 Bell Ave., Altoona, PA (US) 16602

( * ) Notice: Subject to any disclaimer, the term of this patent is extended or adjusted under 35 U.S.C. 154(b) by 22 days.

(21) Appl. No.: 11/397,821

(22) Filed: Apr. 3, 2006

Related U.S. Application Data

(60) Provisional application No. 60/672,152, filed on Apr. 12, 2005.

(51) Int. Cl.
*A63B 22/04* (2006.01)
*A63B 71/00* (2006.01)

(52) U.S. Cl. ..... 482/52; 482/139

(58) Field of Classification Search ..... 482/66, 482/70, 53, 52, 51, 57, 139, 80, 45, 46, 50; 296/26.11, 26.15, 190.06; 360/256.4; 162/344; 601/23, 35, 36, 34; 43/58
See application file for complete search history.

(56) References Cited

U.S. PATENT DOCUMENTS 5,013,031 A * 5/1991 Bull ..... 482/52
5,116,294 A * 5/1992 Findlay ..... 482/52
5,129,872 A * 7/1992 Dalton et al. ..... 482/52
5,199,931 A * 4/1993 Easley et al. ..... 482/52
5,938,569 A * 8/1999 Lin ..... 482/52
6,063,008 A * 5/2000 McBride et al. ..... 482/52
6,102,833 A * 8/2000 Chen ..... 482/53
6,997,854 B2 2/2006 Yang ..... 482/53
2003/0013583 A1 * 1/2003 Anderson et al. ..... 482/52

OTHER PUBLICATIONS

U.S. Appl. No. 10/425,300, filed Apr. 29, 2003, Maser.
U.S. Appl. No. 60/632,257, filed Dec. 1, 2004, Maser.
Ref. Material: 4 Sheets of Linex Owners Manual for Stepper X536.

* cited by examiner

*Primary Examiner*—Stephen R. Crow
*Assistant Examiner*—Sundhara M Ganesan

(57) ABSTRACT

A pivotal add-on apparatus holds down the pedals of any suitable stepper-exercise-machine so that the stepper can be mounted easily. Before the user dismounts the stepper the user takes the handle of the apparatus in his hand and swings an engagement member down to hold the pedals of the stepper down near their lowest position. The pedals stay in this low position until the user mounts the stepper again. One end of the handle of the apparatus is hung on a peg, and the peg is connected to the stepper in a convenient location with a peg fastener. The other end of the handle is connected to a flexible member that is connected to the engagement member. The engagement member is connected to a post that is connected to a pivot. The pivot is connected to the stepper with a pivot attachment.

7 Claims, 5 Drawing Sheets

PIVOTAL ADD-ON APPARATUS FOR STEPPER

CROSS REFERENCE TO RELATED APPLICATIONS

This application is based on provisional application No. 60/672,152 filed on Apr. 12, 2005

BACKGROUND OF THE INVENTION

1. Field of the Invention

The present invention relates to a stepping exercise machine with independent acting pedals wherein the pedals are held down for easy mounting.

2. Background of the Prior Art

Presently to mount an economically priced stepper, one must step very high to access the pedals. This is a deterrent to older individuals and those with health problems.

Shown in my U.S. patent application Ser. No. 10/425,300 is a medium priced stepper with dependent acting pedals. This stepper has pedals that can be lowered to the floor and lift the user to a higher position where the user can work the pedals freely.

A well-equipped rehabilitation clinic might have one large, heavy, complicated, and expensive stepper that can do the same thing as the stepper in application Ser. No. 10/425,300, but its expense limits its use to appointed times at the clinic.

Shown in U.S. Pat. No. 6,997,854 is an economically priced stepper that has an adjustable pedal height. The pedal height is adjustable in the medium range. The adjustment must be done while the user is off the machine. If this stepper is set at a low mounting position, the user is limited to very small steps while he is on the machine.

The present invention is an add-on device to an existing stepper with independent pedal action and is a very affordable compromise over the previously referenced steppers with dependent pedal action. A low step up to each pedal is made possible with this device.

The add-on device shown in abandoned provisional U.S. patent application No. 60/632,257 does the same thing as the present invention, but the device is more expensive to produce and more difficult to install and use.

SUMMARY

The present invention relates to an add-on apparatus that holds down the foot pedals of any suitable stepper-exercise-machine making them lower and easier to mount. The apparatus is comprised of a pivot attachment, a pivot, a post, an engagement member, a flexible member, a peg, a peg fastener, and an anti-slip means. The pivot of the apparatus is connected to the main frame of the stepper with the pivot attachment. The pivot is connected to the first end of the post, and the second end of the post is connected to the engagement member. The engagement member is connected to the bottom end of the flexible member, and the top end of the flexible member is detachably connected to the peg. The peg of the apparatus is connected to the main frame of the stepper with the peg fastener. An anti-slip means is used to keep the engagement member from slipping out of engagement position.

DRAWING FIGURES

In the following drawings and description, longitudinal and transverse are perpendicular directions. Transverse is parallel to the long axis of an elongated engagement member 53 FIG. 1 and longitudinal is perpendicular to it. Near is closer to the reader and far is farther from the reader.

Because the add-on apparatus is mostly symmetrical about its longitudinal axis, for simplification, one reference-character is used for a mirrored item on both the reader's left and right side. For further simplification one reference-character is used for the same fasteners within a group.

Although one skilled in the art would have little trouble making the apparatus from the drawings and the reference-character list alone, the following text will further describe the apparatus for those without these special skills.

DESCRIPTION

Herein described is one way of making the apparatus. An arbitrary mix of manufacturing methods is used to produce this embodiment. The applicant is seeking a patent on the apparatus itself and not one of its embodiments.

The herein described apparatus is attached to a Linex X536 Comfort Rail Stepper as an add-on apparatus but could be attached to any suitable stepper. The apparatus holds the stepper's spring-loaded-pedal-beams down so the pedals can be easily mounted.

The Linex X536 Comfort Rail Stepper is referred to as the stepper in the following description and the "X536 Owner's Manual" as "LXOM".

Figure 3:
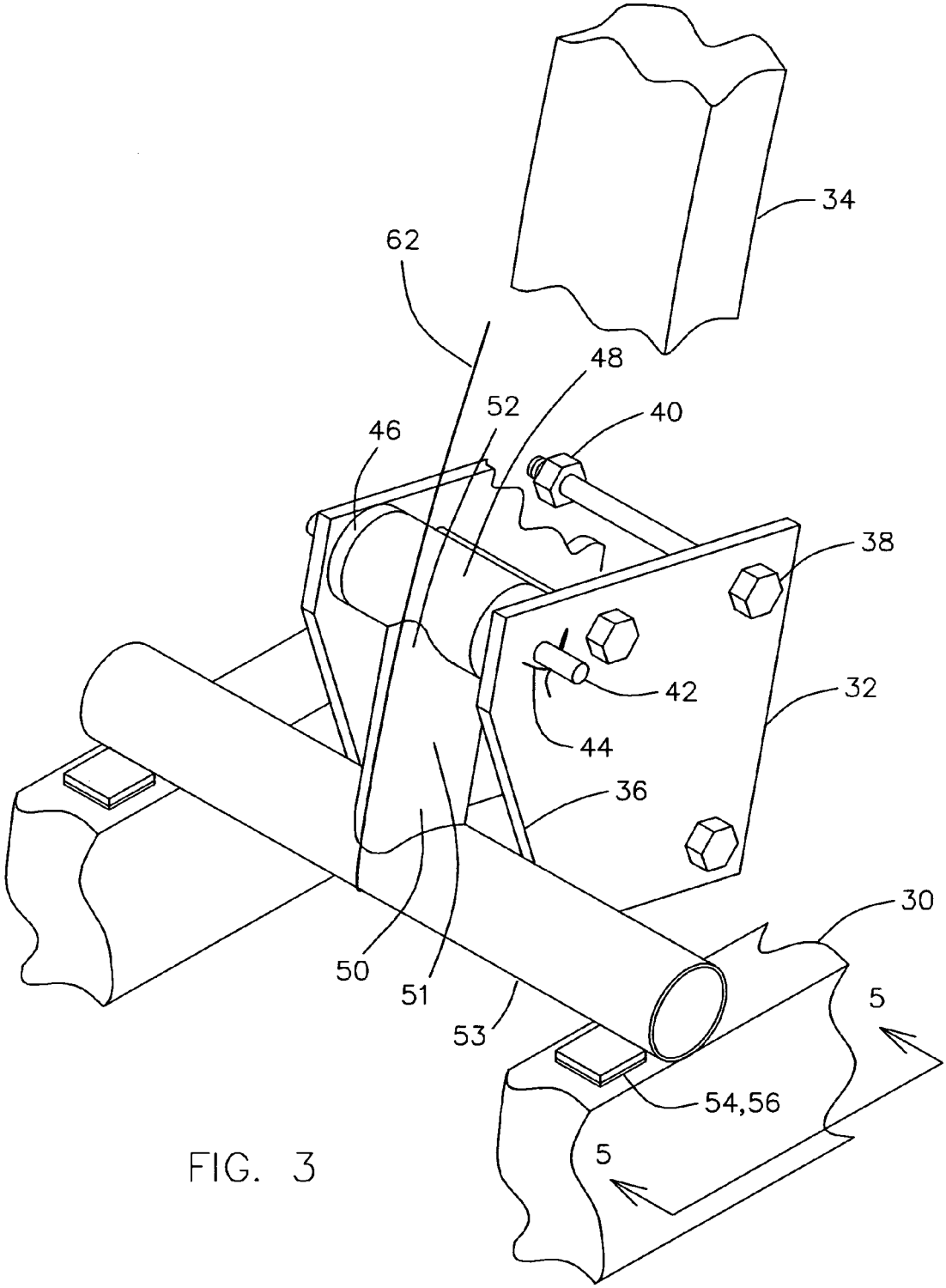
FIG. 3 is an enlarged view taken along line 3-3 of FIG. 1.

In FIG. 3 the elongated engagement member 53 is made of round hollow steel tubing and is shown in engagement position directly over the pedal beams 30 of the stepper near their lowest position. (For these complete pedal beams 30 see parts #6, 7, 8 in the LXOM on pages 6, 13.) Engagement member 53 is long enough to block the vertical up and down path of both pedal beams 30 simultaneously and the long dimension of the engagement member is perpendicular to the long dimension of both pedal beams. The longitudinal cross section and strength of the engagement member 53 is sufficient to hold the pedal beams 30 down near their lowest position.

Figure 4:
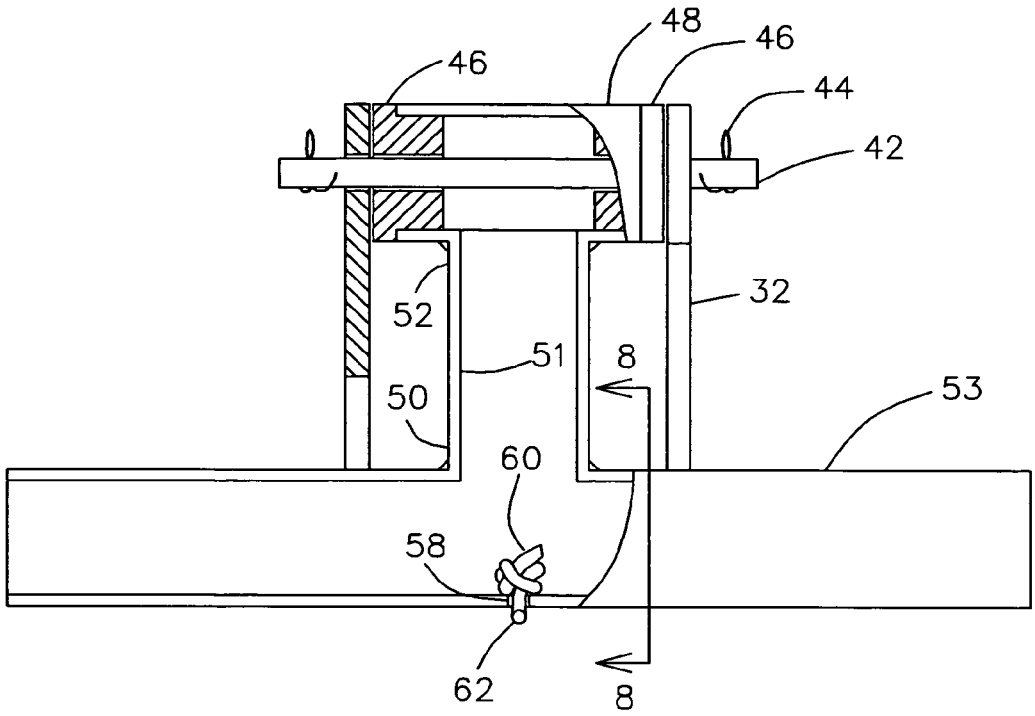
FIG. 4 is an enlarged view with a broken out section taken along line 4-4 of FIG. 1.

A post 51 is made of the same hollow steel tubing as the engagement member 53 for appearances. A first end 50 of the post 51 is perpendicularly joined to the transverse middle of the engagement member 53 by welding. The length of the post 51 is long enough to pivot the engagement member to its engagement position. This position is shown here and in FIG. 1. It is also long enough to pivot the engagement member 53 to its disengagement position in FIG. 2. The disengagement position is over and clear of the pedal beams 30 when they are all the way up. The length of the post 51 is equal to half the distance between the engagement and disengagement positions of the engagement member 53 FIGS. 1 and 2 respectfully. In FIG. 4 the central portion of an axle rod 42 is coaxial with a hub 48 that is also made of the same hollow steel tubing as the engagement member 53 for appearances. The transverse middle of the hub 48 is perpendicularly joined to the second end 52 of the post 51 by welding. Engagement member 53, post 51, and hub 48 lie in the same plane. The hub 48 has a rigid plastic bushing 46 in its left and right end. The assembled hub, hub 48 and a left and right bushing 46, has an overall transverse length that is slightly less than the transverse dimension of the main frame 34 FIG. 1 of the stepper. (For the main frame 34 and the stepper see part #3 in the LXOM on pages 6, 9.) The left and right bushings 46 FIG. 4 are identical to each other and each has two portions that are of different diameter. These diameters are concentric to each other, and the meeting of the different diameters makes a shoulder that abuts an end of the hub 48. The smaller diameter is on the inner end of bushing 46 and fits into an end of the hub 48. The larger diameter is on the outer end of bushing 46 and abuts against mounting plate 32. The lengths of the diameters are sufficient to produce bushings strong enough to withstand the various loads generated by the operation of the apparatus. The bushings are part of the pivot and have a through transversely directed hole concentric to their outside diameters with an opening large enough to freely pass the outside diameter of the axle rod 42. The axle rod extends through the transversely directed holes of the left and right bushing 46 to and through holes in a left and a right mounting plate 32 far enough to accept a fastening means that holds the axle rod 42 in place. The axle rod 42 and the left and right mounting plate 32 are part of the pivot. The fastening means of the axle rod 42 is a left and right carter pin 44 that passes through a through corresponding left and right hole in the axle rod. These holes are perpendicular to the long dimension of the axle rod.

One of the alternatives to the welded items 53,51,48 and the left and right bushings 46 is to replace these items with a single, solid, rigid, plastic molding with a transversely directed hole through it for axle rod 42.

One of the alternatives for the fastening means is to use a left and right locknut in conjunction with an axle rod 42 that is threaded on its ends to accept these locknuts.

As shown in FIG. 3, in addition to the hole for axle rod 42 the right mounting plate 32 contains at least two additional through holes that are parallel to the axle rod 42 and that align with corresponding through holes in the left mounting plate 32, and each set of the aligned holes pass the shank of a transverse bolt 38 that then engages a lock nut 40. Each of the bolts are located longitudinally near and far of the main frame 34. When tightened, the bolts 38 clamp the mounting plates 32 to the main frame 34 and fix the position of the axle rod 42.

The left and right rectangular steel mounting plates 32 and steel bolts 38 are sized to be strong enough to produce the clamping force necessary to fix the mounting plates in a stationary position in reference to the main frame 34 while resisting the various loads generated by the operation of the apparatus.

The longitudinal and vertical dimensions of the mounting plates 32 are of a size to produce an area that will adequately surround the through holes for bolts 38 and axle rod 42. The near, lower corners of the mounting plates 32 are cut at a relief angle 36 to give clearance to the engagement member 53 in engagement position.

In FIG. 4, the hollow engagement member 53 has located in its transverse middle opposite to the post 51 a wall opening 58 that goes through one wall. The opening can freely pass a flexible member 62, but is too small to pass a knot 60. The knot 60 is tied in the lower end of the flexible member 62 and is inside the steel tube of the engagement member 53. The flexible member 62 is made of a flexible material such as twisted nylon fiber.

The attachment means of flexible member 62 to the engagement member 53 is knot 60.

To tie the knot 60, the flexible member's lower end is pushed from the outside to the inside through the wall opening 58 in the engagement member's wall. This end is reached and grabbed with a pair of forceps through one of the engagement member's open ends then, pulled to the outside where the knot can be tied. The knot is then pulled back into the engagement member 53 by the upper end of the flexible member until it meets the wall opening 58.

One of the alternatives to the internal knot 60 is a self-threading steel eyelet screwed into the wall opening 58. The externally projecting eyelet is then tied to the lower end of the flexible member 62.

Figure 1:
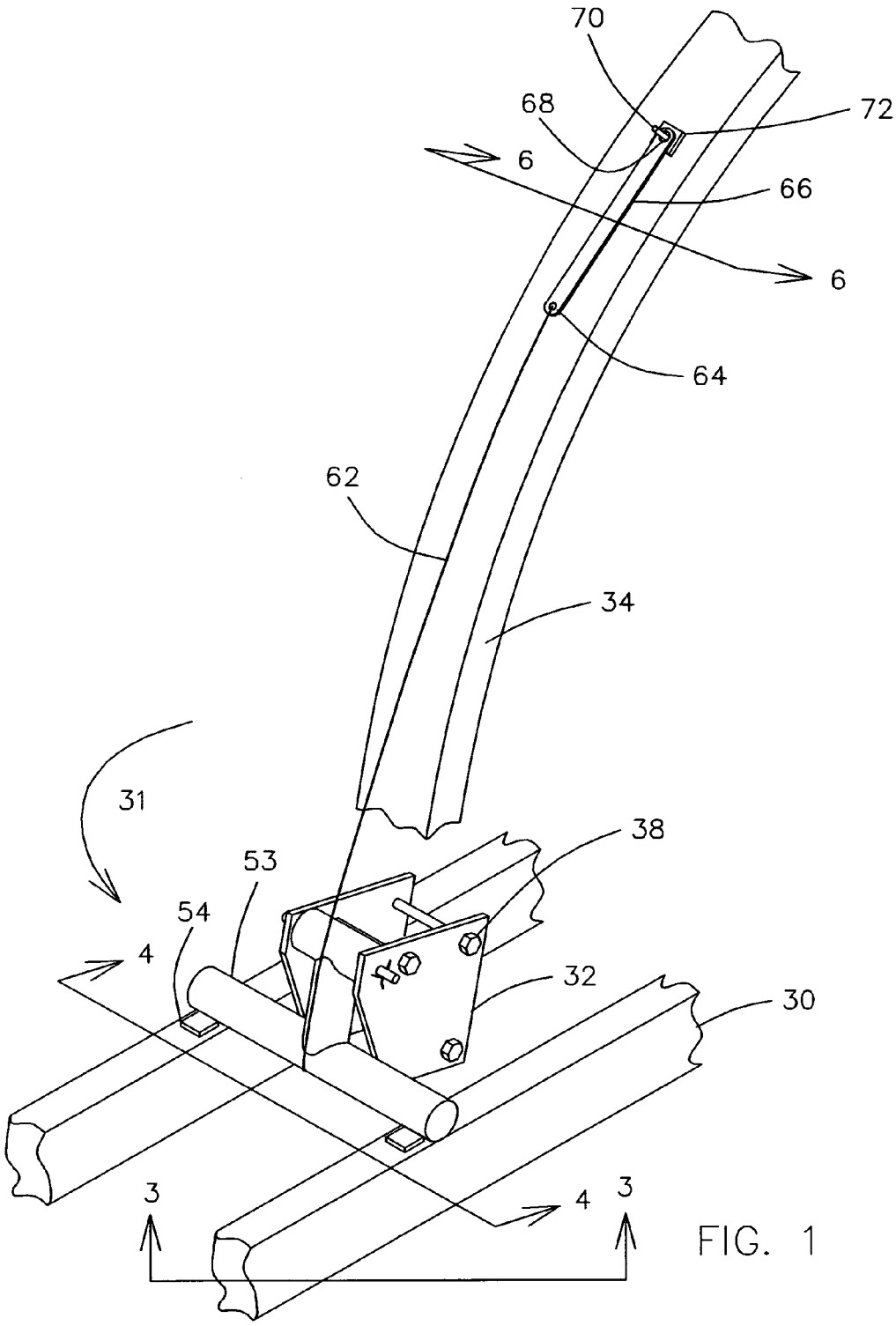
FIG. 1 is a perspective view showing the complete device in engagement mode.

The flexible member 62 continues from the engagement member 53 for a length of about four feet (this length will be trimmed to fit during the installation of the apparatus) to a first opening 64 FIG. 1 in the lower end of an elongated handle 66. The handle is made of rigid plastic and is sized in length so that when it is flipped up and down, it will aid in pivoting of the engagement member 53 up and down.

Figure 6:
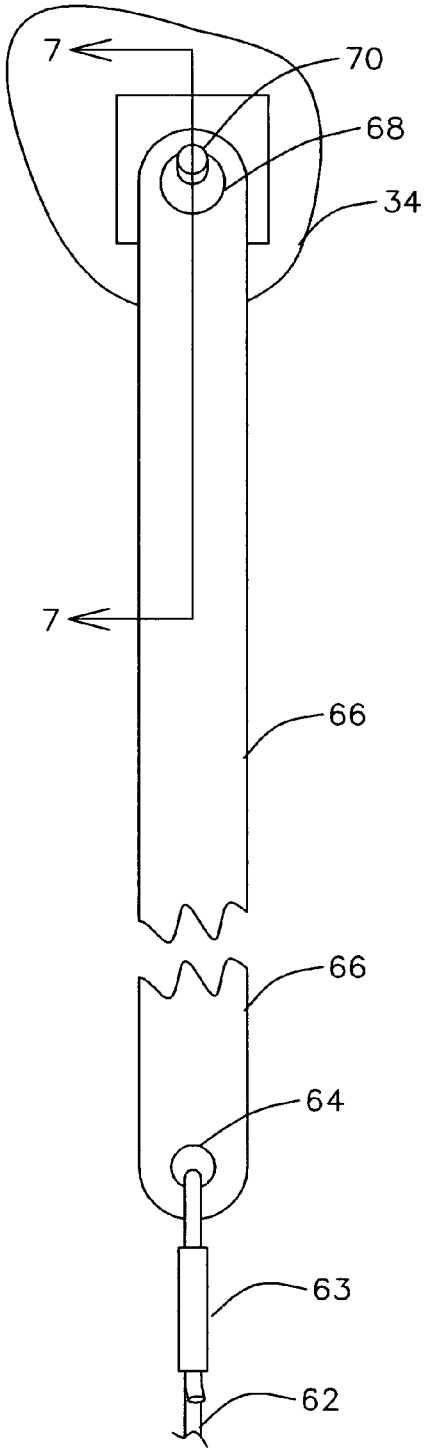
FIG. 6 is an enlarged view taken along line 6-6 of FIG. 1

In FIG. 6 the first opening 64 is perpendicular to the handle's long dimension. The flexible member 62 freely passes through the first opening and attaches to itself with a rope clamp 63 forming a closed loop through this first opening and around the bottom of handle 66. The rope clamp is pre-assembled by lightly crimping with a pair of pliers. The rope clamp 63 is a smaller version of a Campbell rope clamp B7679034 distributed by Cooper Tools and is used in place of hand tied knots for appearance. The handle 66 has a second opening in its other end perpendicular to the handle's long dimension. The second opening fits loosely over a peg 70.

Viewing FIG. 1 it is apparent that child safety issues may require that a stiff portion be added to the flexible member 62 between the engagement member 53 and the handle 66. One method of doing this would be to interpose an item similar to the handle 66 between engagement member 53 and the handle 66. The item would be as long as possible and both its top and bottom connection to the flexible member 62 would be the same as the bottom connection of handle 66.

As shown in FIGS. 1 and 3 an easily made and inexpensive pivoting apparatus holds down the pedals of a suitable stepper-exercise-machine. A child safety feature is easily built into the apparatus.

REFERENCE CHARACTERS

30 pedal beam (LXOM)
31 down arrow
32 mounting plate
33 up arrow
34 main frame (LXOM)
36 relief angle
38 bolt
40 lock nut
42 axle rod
44 carter pin
46 bushing
48 hub
50 first end of post
51 post
52 second end of post

53 engagement member
54 keeper block
56 block fastener
58 wall opening
60 knot
62 flexible member
63 rope clamp
64 first opening
66 handle
68 second opening
70 peg
72 peg base
74 peg fastener

INSTALLATION AND OPERATION

Figure 2:
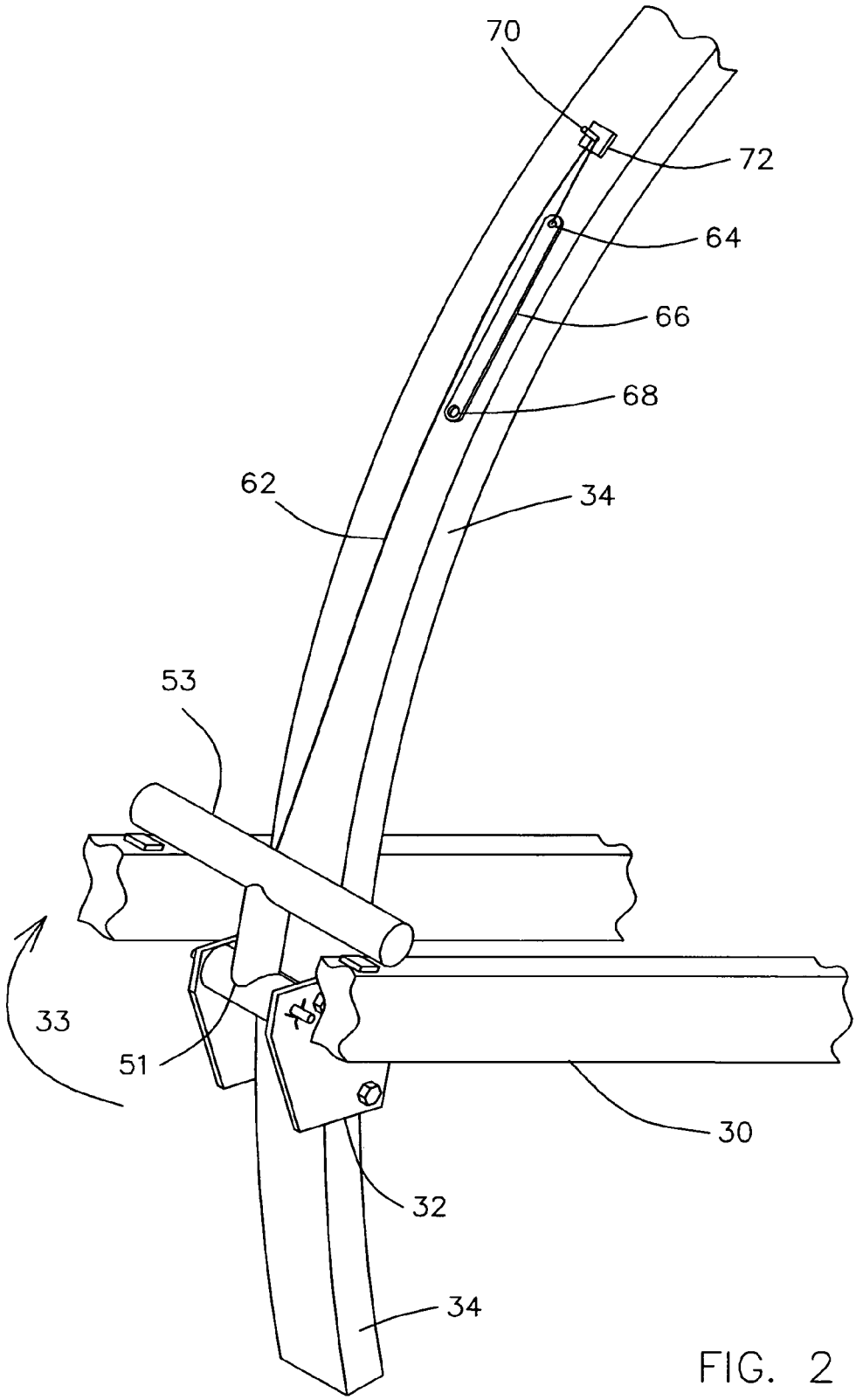
FIG. 2 is a perspective view showing the complete device in disengagement mode.
Figure 7:
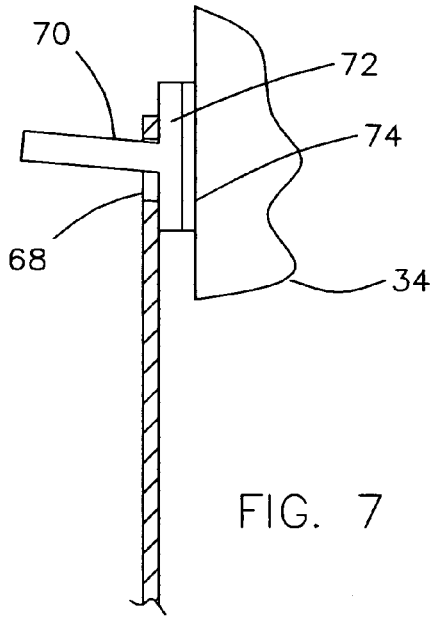
FIG. 7 is a partial section taken along line 7-7 of FIG. 6.
Figure 8:
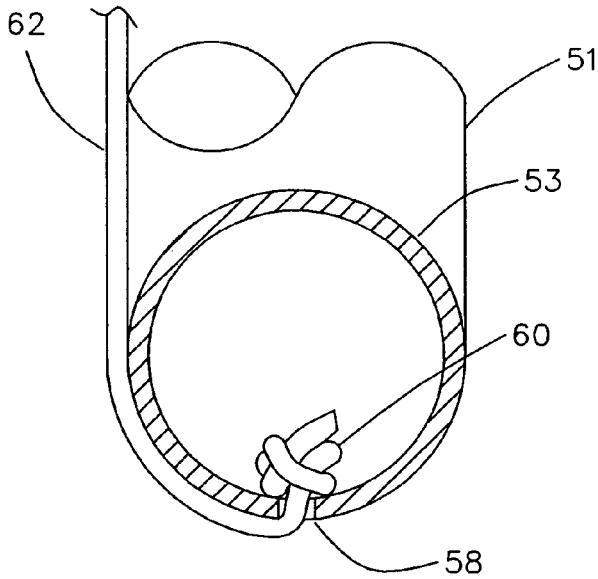
FIG. 8 is a partial section taken along line 8-8 of FIG. 4.

To install the apparatus in FIG. 2, the user installs peg 70 and its base 72, Wal-Mart's "Bulldog" cup hook PH-410, on the near face of the arching main frame 34 of the stepper with the included foam mounting tape as fastener 74 FIG. 7.

One of the alternatives for peg 70 is to simply weld the end of a metal peg to the near face of the main frame 34 FIG. 2.

Figure 5:
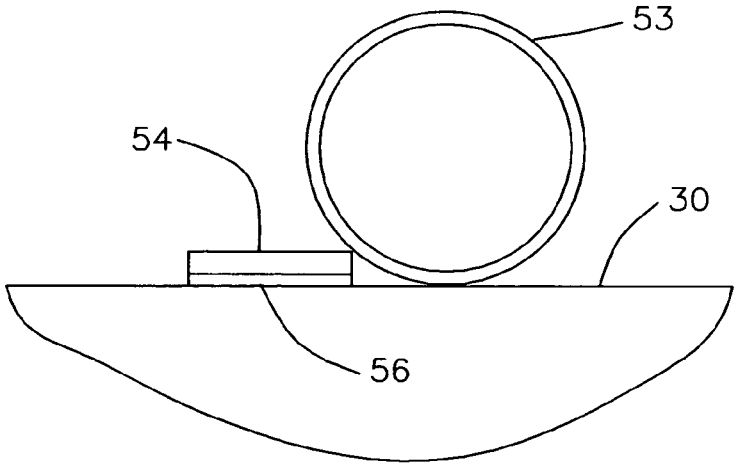
FIG. 5 is an enlarged view taken along line 5-5 of FIG. 3.

The peg 70 extends perpendicularly from the near face of the arching main frame 34 and is located close to its vertically directed centerline at a height that is easy for the user to reach. The user now installs the apparatus loosely around main frame 34 so that the engagement member 53 is in its disengagement position directly over the pedal beams in their highest position and just outside the arching main frame of the stepper as shown. Flexible member 62 is now laid over peg 70 and the handle 66 is left hanging upside down. The user now mounts the stepper and pushes the pedal beams 30 down as shown in FIG. 1 to their lowest position. The user pulls the handle 66 FIG. 2 towards himself and turns it to its upright position in order to pivot the engagement member 53 down into place on top of the pedal beams 30 as shown by down arrow 31 FIG. 1. The handle 66 is now hung in position by placing its second opening 68 over peg 70. The add-on apparatus is now adjusted so that the engagement member 53 sits on top of pedal beams 30. The apparatus is fixed into place by tightening bolts 38. An anti-slip means, keeper block 54, is a flat square of rigid plastic large enough to prevent the engagement member 53 from slipping out of position. It is installed with a fastener 56 FIG. 5 on top of each pedal beam 30 near the engagement member 53. Wal-Mart's "Scotch" foam mounting tape Cat#314 is used for fastener 56.

The keeper blocks 54 are fastened with their thin edges perpendicular to the top of the pedal beams as shown.

One alternative to the keeper block 54 is to roughen the top surface of the pedal beams 30 under the engagement member 53 to increase friction and prevent slipping.

The flexible member 62 FIG. 6 is adjusted in length to remove any slack by pulling on its free end. This action moves the flexible member 62 through the previously lightly assembled rope clamp 63. The rope clamp 63 is then permanently crimped with a pair of pliers and the excess flexible member 62 is cut off.

To operate the apparatus in FIG. 1, the apparatus is set to the disengaged mode by pivoting the engagement member 53 up with handle 66 and then in FIG. 2 hanging the flexible member 62 over peg 70. See up arrow 33. The pedal beams 30 and pedals are now free to be used for exercise.

Before the user dismounts the stepper, he sets the apparatus to the engaged mode of FIG. 1 by pulling handle 66 FIG. 2 towards himself and turning it right-side up, thereby pivoting the engagement member 53 down behind the keeper blocks 54 FIG. 1. See down arrow 31. The handle 66 is now fixed in position by placing its second opening 68 over peg 70.

The next time the machine is used the pedal beams 30 are still held in their lowest position and can be mounted without stepping high.

As shown in FIGS. 1 and 2 the previously described pivoting apparatus is easily installed and operated. It holds down the pedals of a stepper-exercise-machine so that the user can mount them easily.

While we have shown and described an embodiment in accordance with the present invention, it should be clear to those skilled in the art that further embodiments may be made without departing from the scope of the present invention.

What is claimed is:

1. An add-on apparatus for holding the foot pedals of a modifiable stepper-exercise-machine down for easy mounting, said modifiable stepper having two pedals that move along a substantially vertical path, a central upright member that is attached to a base, and a bar for the users hands to grip, said add-on apparatus is comprised of a pivot connected to said central upright member of said modifiable stepper with a pivot attachment, a hub connected to said pivot, a post with its first end connected to said hub, an elongated engagement member with its lateral middle portion connected to a second end of said post, a flexible member with a bottom end connected to said engagement member and a top end detachably connected to a peg, said flexible member lowers said engagement member down into engagement position and raises said engagement member up into disengagement position, a peg fastener connected to the far end of said peg and to the main frame of said stepper, an anti-slip means to prevent said engagement member from slipping out of engagement position.

2. The add-on apparatus of claim 1 wherein part of said pivot is an axle rod and a left and right mounting plate, said axle rod passes through an opening in each of said mounting plates, said mounting plates are connected to said stepper's main frame with said pivot attachment and said axle rod is held in position with a fastening means.

3. The add-on apparatus of claim 2 wherein said pivot attachment is at least two bolts with a locknut each, each of said bolts pass through an opening in each of said left and right mounting plates, thereby clamping said mounting plates to the main frame of said stepper.

4. The add-on apparatus of claim 2 wherein said fastening means for holding said axle rod in position is a left and right carter pin, each of which is located outside of the respective said left and right mounting plate, each of said carter pins is perpendicular to the long dimension of said axle rod and passes through a corresponding left and right opening in said axle rod.

5. The add-on apparatus of claim 1 wherein said hub, said post and said engagement member are hollow steel tubes connected by welding, the hollow steel tube of said hub has a rigid plastic bushing in each of its ends, each of said bushings has an inner end, a shoulder, and an outer end, said shoulder abuts an end of the hollow steel tube of said hub, said outer end abuts one of said mounting plates.

6. The add-on apparatus of claim 1 wherein said anti-slip means is located on the top of one or both of the pedal beams of said stepper and located adjacent to said engagement member in engagement position, said anti-slip means is comprised of a keeper block and a block fastener, said keeper block is a thin flat square of rigid plastic, said block fastener is a square of foam mounting tape, said block fastener is positioned between a square face of said keeper block and the top of a pedal beam.

7. The add-on apparatus of claim 1 wherein said peg and said peg fastener is a purchased, rigid plastic, straight, cup hook, comprised of a peg, a base, and a peg fastener, said peg fastener is a square of foam mounting tape, said peg fastener is positioned between said peg base and the main frame of said stepper.

* * * * *